United States Patent [19]

Foster

[11] Patent Number: 4,553,945

[45] Date of Patent: Nov. 19, 1985

[54] BOAT PROPULSION

[75] Inventor: Daniel S. Foster, Grosse Pointe Woods, Mich.

[73] Assignee: Foster Marine Products, Inc., Warren, Mich.

[21] Appl. No.: 450,287

[22] Filed: Dec. 16, 1982

[51] Int. Cl.[4] ..... B63H 5/16

[52] U.S. Cl. ..... 440/51; 440/66; 114/162

[58] Field of Search ..... 440/51, 66–69, 440/71, 79, 84; 114/144 R, 162

[56] References Cited

U.S. PATENT DOCUMENTS

| | | | |
|---|---|---|---|
| 904,313 | 11/1908 | Davis | 440/66 |
| 3,057,320 | 10/1962 | Daniels | 440/112 |
| 3,742,895 | 7/1973 | Horiuchi | 440/66 |
| 4,003,330 | 1/1977 | Compton | 440/111 |
| 4,008,677 | 2/1977 | Wordell | 114/162 |
| 4,057,027 | 11/1977 | Foster | 440/69 |
| 4,443,202 | 4/1984 | Arena | 440/51 |

FOREIGN PATENT DOCUMENTS

| | | | |
|---|---|---|---|
| 2028746 | 3/1980 | United Kingdom | 440/79 |
| 2033324 | 5/1980 | United Kingdom | 440/66 |

*Primary Examiner*—Trygve M. Blix
*Assistant Examiner*—Stephen P. Avila
*Attorney, Agent, or Firm*—Barnes, Kisselle, Raisch, Choate, Whittemore & Hulbert

[57] ABSTRACT

A safety shroud for attachment to the rear surface of the transom of an unmodified boat hull equipped with an inboard engine and a propeller tube and shaft rigidly fixed to the engine and extending with clearance through an enlarged opening in the transom, and a propeller on the shaft; the shroud being longitudinally and transversely downward concave to overlie the top and partly enclose the sides of the propeller, the shroud in longitudinal section being upwardly and rearwardly curved from the forward bottom edge of the shroud to just ahead of the propeller zone and then extending straight rearwardly. The lateral edges of the shroud extend generally upwardly and rearwardly from the forward bottom edge of the shroud to merge with the top rear edge thereof. Preferably the shroud is composed of inner and outer interconnected plastic shells, the outer shell having a downward concave reinforcing strut, closed at its bottom by the inner shell, and having a metal rudder support shaft therein. The shroud and boat together constitute a new and improved combination.

4 Claims, 8 Drawing Figures

BOAT PROPULSION

BRIEF SUMMARY OF THE INVENTION

The present invention is a carrying forward of the concept illustrated and described in my prior U.S. Pat. No. 4,057,027, in which a boat having an inboard engine is modified to provide a water channel or duct extending forward from its transom to control the flow of water to a surface running propeller located partly in the duct and in general alignment with the boat transom.

The present invention has as its primary aim the provision of a safety shroud mounted on the rear surface of a transom of a boat which is itself unmodified. The boat has an adjustable inboard engine and transmission to which is rigidly connected a propeller guide and support tube housing the propeller shaft which locates the propeller substantially aft of the transom.

The shroud may be formed of metal components, but a preferred embodiment of the invention includes a two piece plastic construction made up of an outer or upper shell and an inner or bottom shell. The efficient operation of the shroud requires a special bottom or inner conformation with reference particularly to the location of the propeller. Specifically, the shroud overlies the propeller, and is shaped to provide a downwardly open duct which in longitudinal section is concavely curved to extend upwardly and rearwardly from adjacent the bottom edge of the transom to just forward of the propeller zone. In the propeller zone, and rearwardly therefrom, the inner surfaces of the duct walls extend straight rearwardly. In transverse section, the bottom surface of the shroud is downwardly concavely curved to conform generally to the propeller arc.

The propeller tube extends with clearance through an opening in the transom, and the opening is sealed by a flexible tubular boot. The engine is mounted on adjustable resilient mounts, and since the propeller tube is not mechanically connected to the boat hull, an exceptionally quiet combination results.

Although the shroud may include a strut connected to the propeller tube, it has been found that a strut is unnecessary.

In operation the propeller is surface running, by which is meant that the center of the propeller is above the level of water within the shroud, so that the blades are submerged only through a lower arc of less than 180°.

The rudder is mounted directly aft of the propeller which provides a very efficient steering action. In the preferred construction, in which the shroud component shells are shaped reinforced plastic sheet material, such as fiber glass, the upper shell has a longitudinally extending downwardly open hollow reinforcing strut or rib which is closed by the inner or lower shell. With this construction a metal rudder shaft support is provided to fit solidly within the rib and closure.

The present construction facilitates start-up of the boat before a planing condition is achieved at 18–20 m.p.h. by ducting water to the propeller. When planing, the propeller as previously indicated, is in a "surface running" condition in which in the upper arc of movement, the propeller blades are above the water.

DETAILED DESCRIPTION

The safety shroud disclosed herein may be fabricated from metal sheet material, but preferably composed essentially of two reinforced plastic shells, which may be shaped fiberglass sheet material bonded together over a relatively large area so as to be effectively unitary.

Referring first to FIGS. 1–5, the plastic assembly is illustrated as composed essentially of an upper or outer shell and a lower or inner shell. It is to be understood that the invention includes both the safety shroud alone, and the combination of the boat, engine, propeller and shroud. The shroud has been designed and tested with the propeller in a predetermined position, and the intermediate portion of the shroud is described as located at the propeller zone.

The shroud indicated in its entirety at 10 is composed essentially of an outer shell 12 and an inner shell 14. Both shells are formed of shaped reinforced plastic sheet material of substantially uniform thickness. A suitable material for these shells is fiberglass, and a wall thickness of 0.2–0.3 inches may be provided.

Figure 1:
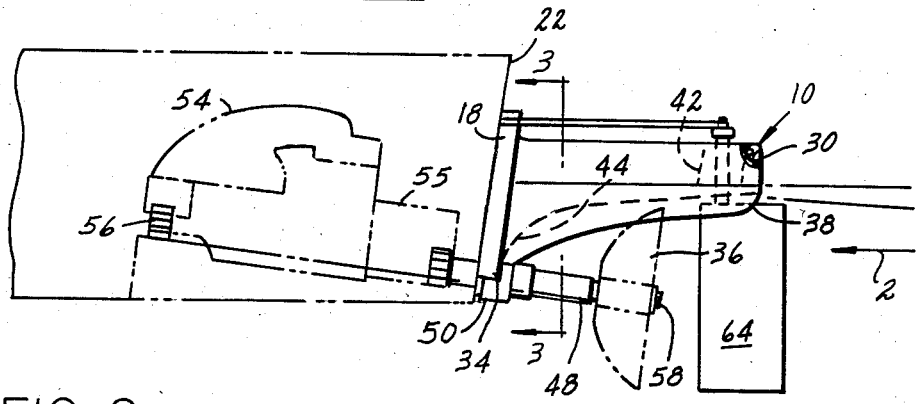
FIG. 1 is a fragmentary side elevation of a boat equipped with the shroud of the present invention.
Figure 2:
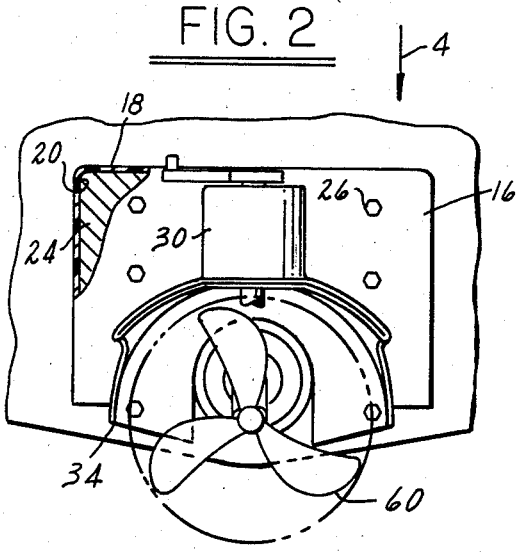
FIG. 2 is a rear elevation looking in the direction of the arrow 2, in FIG. 1.

The outer shell 12 has a generally upright forward flange 16 having a continuous forwardly extending reinforcing flange 18 which defines a forwardly facing cavity 20. When the shroud is attached to the rear surface of the boat transom 22, this cavity receives a filler plate 24 through which fastener bolts 26 extend. A stiffening and reinforcing hollow downwardly open rib 28 extends rearwardly for the full length of the shroud and is closed at its after end by an integral wall 30. In transverse section, downwardly and outwardly curved flanges 32 are provided. The bottom longitudinally extending edges of those flanges, as best seen in FIGS. 1 and 2, curve from points 34 upward and rearwardly to the intermediate or propeller zone as indicated at 36 where the edges become substantially straight and are inclined slightly upward and rearwardly. From the propeller zone, the edges curve upwardly as indicated at 38 to merge with the end wall 30 of hollow rib 28.

Figure 3:
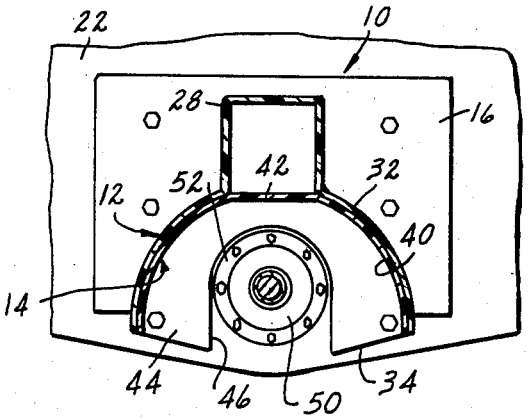
FIG. 3 is a section on the line 3—3, FIG. 1.
Figure 4:
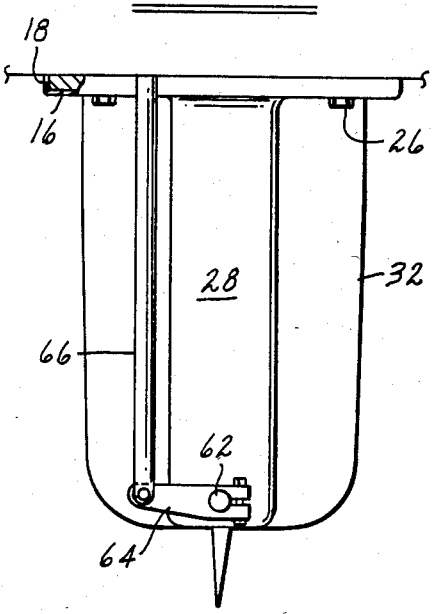
FIG. 4 is a plan view of the shroud, looking in the direction of the arrow 4, FIG. 2.
Figure 5:
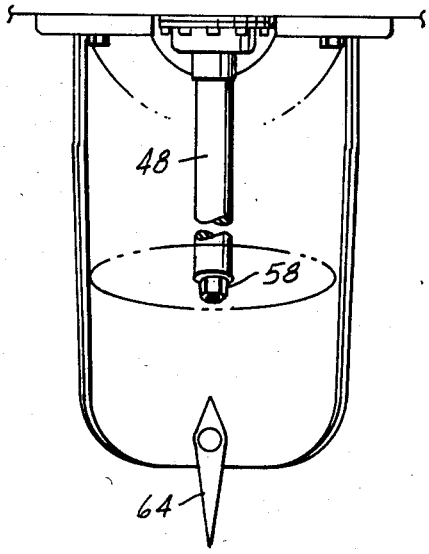
FIG. 5 is bottom plan view of the shroud.

The inner shell 14 of the shroud assembly has laterally and downwardly curved flanges 40 which conform to the corresponding flanges 32 or the outer shell, and which have substantially fully engaged matching surfaces therewith. These surfaces are bonded, preferably throughout, by a suitable cement, and hence provide an assembly in which the side flanges are of double thickness as best seen in FIG. 3. In addition, the inner shell 14 includes a flat horizontal wall 42 which closes the bottom of rib 28.

The most important function of the inner shell 14, however, is to provide a guide surface which controls flow of water as the boat is started up from a standing position and as it attains and maintains planing speed. For this purpose its forward end is provided with a rearwardly facing wall 44, curved upwardly and rearwardly from the bottom edge indicated at 34. The wall 44 is provided with an enlarged opening 46 extending upwardly from the bottom edge 34, dimensioned to provide substantial clearance for the propeller support tube 48, which extends through an enlarged opening in the transom. This opening is sealed by a tubular flexible boot 50 having a radial flange 52 fastened directly to the rear surface of the transom 22.

The curved contours of the inner surface of the inner shell 14, both in transverse and longitudinal cross-section and their relationship to the propeller zone, are critical.

As best seen in FIG. 2, the transverse section of the shroud conforms closely to the arc of the tips of the propeller 60. Also the radius of upward and rearward curvature of the inner surface of the inner shell, commencing at the lower forward edge thereof as indicated at 34 in FIG. 1, is slightly greater than the radius of the path 62 of the tips of the propeller blades.

The inboard engine 54 with the transmission 55 is mounted on the yieldable adjustable engine 56 mounts which may be of conventional design. The propeller shaft 58 extends through tube 48, so that the only mechanical connection between the unitary engine, transmission, propeller, tube, propeller shaft 58, and propeller 60 on one hand and the boat hull is the resilient engine mounts. This facilitates installation and permits final adjustment of the engine and propeller in desired operating position. The flexible boot 50 of course maintains water tight integrity of the hull while permitting such adjustment.

When the boat is at rest, the propeller is submerged, but in planing the center of the propeller is about $1 \propto 1\frac{1}{2}''$ above the level of water.

The rectangular cross-section rib 28 with the bottom wall 42 provided by the inner shell permits a rectangular or square metal tube section indicated at 62 in FIG. 1 to be assembled in the rib when the two shells are assembled. This provides a pivot support for the post of a rudder 64 located directly aft of the propeller. Suitable steering connections, such as arm 64 and rod 66 are provided.

While the boat illustrated herein is a modified Vee hull, as seen in FIGS. 2 and 3, the invention is applicable to any hull which has a transom onto which the shroud may be applied. In a particular embodiment of the invention, a jet propelled boat which planed at 3000 RPM engine speed and had a top speed of 58 mph at 5200 RPM was modified by substituting the propeller drive as taught herein. The modified boat planed at 1900 RPM engine speed, and had a speed of 67 mph at 4500 RPM engine speed. In general the fuel consumption was about one half that of the jet.

Figure 6:
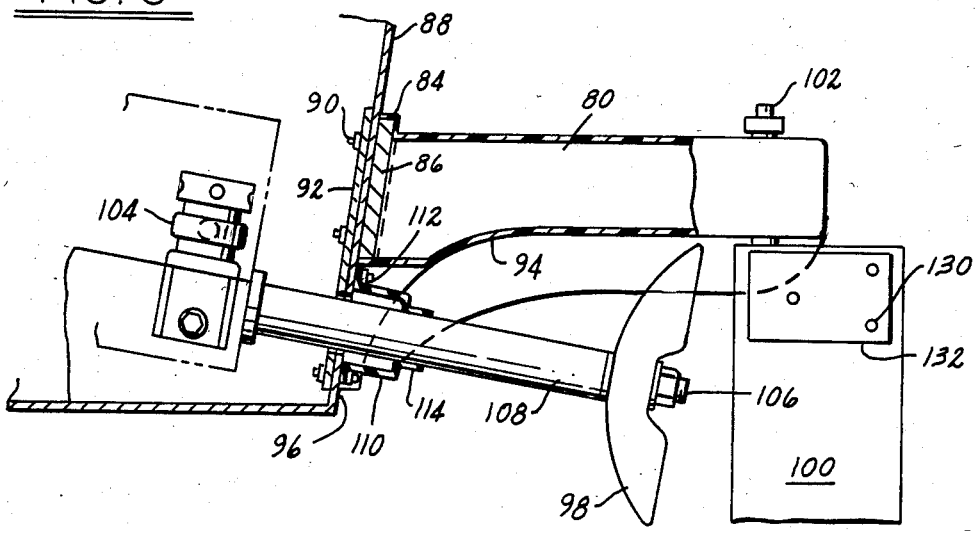
FIG. 6 is a vertical section of a second embodiment of the present invention showing a shroud formed from metal sheet material.
Figure 7:
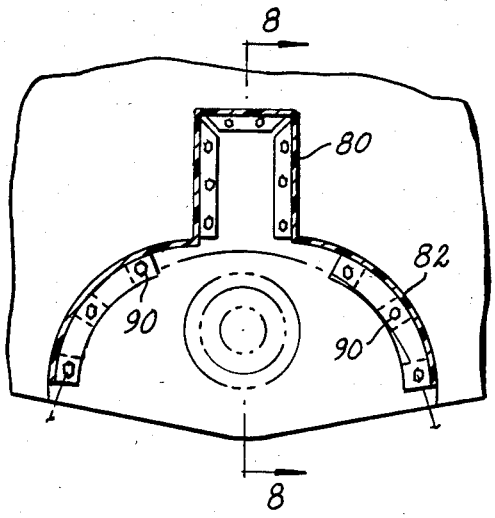
FIG. 7 is a rear elevation of the shroud.
Figure 8:
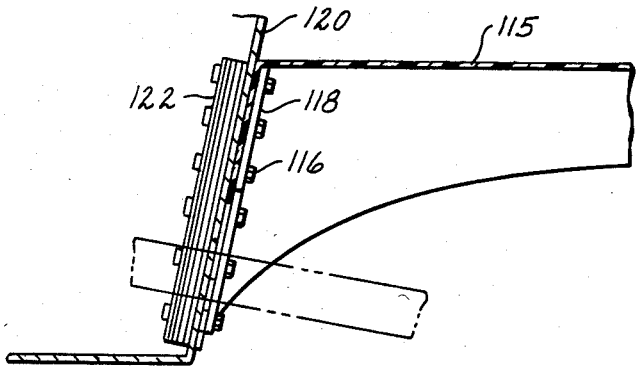
FIG. 8 is a section on line 8—8, FIG. 7.

Referring now to FIGS. 6–8, there are shown further embodiments of the present invention in which the shroud components are formed of sheet metal. Since the critical shape and dimension of parts is essentially the same as the preferred plastic embodiment, the sheet metal construction is only briefly described.

In these embodiments the shroud has the longitudinally extending rib 80 and the downwardly and laterally curved flanges 82. A separate wall (not shown) may be attached to close the underside of the rib. The metal shroud has an offset rearwardly extending peripheral flange 84 which receives a mounting plate 86, which may be of wood, plastic, metal or the like. The shroud is mounted to the transom 88 by bolts 90 extending through a support plate 92.

As before, the shroud is provided with a water control surface indicated generally at 94 which is both longitudinally and transversely concave, and at its forward end curves upwardly and rearwardly from a point 96. The approximate curvature of the forward end of the shroud in a longitudinal vertical plane is slightly greater (by 0.5–1.5″) than the radius of the circle described by the tips of the propeller blades 98.

At the propeller zone and rearwardly therefrom the lower surface of the shroud is described by straight horizontal elements to define the cross-section best seen in FIG. 8.

The rudder 100 is pivotally mounted with a post 102 as seen in FIG. 6, and in this figure there is seen one of the four resilient adjustable engine mounts 104 of known construction. The propeller 98 is mounted on a propeller shaft 106 which extends through the shaft tube 108. The shaft tube is rigidly connected to the engine or engine transmission, so that the propeller can be aligned and positioned by adjustment of the engine supports 104. The propeller shaft tube extends through an enlarged opening in the transom which permits adjustment of the tube. The opening is sealed by a collapsible resilient boot 110 having a flange at its forward end bolted or otherwise secured to the transom, as by bolts 112, and a rearwardly extending annular flange 114 which is clamped to tube 108 by a hose clamp, not shown.

The shroud 115 of FIGS. 7 and 8 has the same design configuration as that of FIG. 6, but differs primarily in that the shroud is secured to the transom by bolts 116 extending through a mounting plate 118 exterior of the transom 120 and a multi-ply stiffening and reinforcing plate 122 at the interior thereof.

In all embodiments, the opening in the transom and the corresponding usually U-shaped opening in the shroud are large enough to permit mounting and demounting of the propeller tube, when the propeller is removed, without disturbing the engine mount.

It will be noted that in both embodiments of the invention, the pivot axis of the rudder is aft of its leading edge, so that balancing forces on the propeller are provided, and the force required for steering may be reduced to any value required, thus eliminating the need for power steering.

The rudder 100 as seen in FIG. 6 is connected, as by three removable fasteners such as bolts 130, between spaced support plates 132, so that when the other two are removed, the rudder may be swung counterclockwise to a clearance position about the upper right fastener as seen in this figure. In practice, the bottom of the rudder is usually about 2–3″ below the propeller blade.

Broadly described, the boat is a Vee-bottom boat, which normally planes with its keel inclined forwardly and upwardly between four and five degrees. The axis of the rudder will be approximately vertical when the boat is at planing speed.

When the boat is in planing condition the water line extends through the propeller zone approximately an inch—one and a half inches below the center line of the propeller. This results in a "surface—running" condition for the propeller when the boat is planing.

The rudder has a substantial portion which extends forwardly of its pivot axis, so that opposing forces are developed by dynamic water pressure, minimizing the force required to move the rudder and avoid the necessity for power assisted steering.

When the boat is at rest the propeller is substantially completely submerged.

In a practical embodiment of the invention the forward edge of the propeller envelope is located approximately 14 inches aft of the transom and the axis of the propeller drive shaft extends at an approximate angle of approximately 10°–12° to the keel.

The combination of the inboard engine, propeller spaced substantially aft of the transom, and the shroud overlying the propeller and curved both transversely and longitudinally to provide for surface running of the propeller, results in a high performance economical boat which requires no hull modification, and can be fabricated with conventional boat hulls without substantial modification.

The performance of the boat is critically affected by the shape of the shroud, and particularly the lower surface, which confronts and partially encloses the propeller, and controls the flow of water therein.

As has been described and as shown in the drawings, the flow-controlling shroud is positioned to overlie and partly surround the propeller or the position to be occupied by the propeller, here sometimes referred to as the propeller zone. The portion of the shroud forwardly of the propeller zone has a lower surface which is downwardly concave in both longitudinal and transverse vertical sections. The lateral bottom edges of the shroud as best seen in FIG. 1, extend upwardly and rearwardly from points 34 to the propeller zone, where the edges, are seen to be slightly below the top of the circle described by the tips of the propeller blades.

The bottom surface of the shroud at the transverse vertical plane at the propeller zone as best seen in FIG. 2, is approximately arcuate and closely spaced outwardly from the arc described by the propeller blades. The lower surface of the shroud in the vertical, longitudinal central plane, as best seen in FIG. 1 or 6, extends upwardly and rearwardly in a smooth curve from the bottom of the shroud at its forward end to a point well aft of the propeller zone. This surface has a maximum curvature at its forward end which diminishes to approximately zero (a straight line) at the propeller zone and aft thereof.

At and rearwardly of the propeller zone, the inner shroud surface is of substantially uniform transverse downwardly concave cross-section in vertical planes.

The boat hull herein is described as unmodified to distinguish from hull modification to provide a tunnel as in my prior above identified patent. With this definition, it is apparent that the new combination may be produced by retrofit of an existing power boat.

I claim:

1. A safety shroud for providing a propeller housing, mounting a rudder and controlling flow of water to the propeller, said shroud being adapted for mounting on the rear surface of a boat transom, said shroud comprising inner and outer shaped shells of substantially uniform wall thickness; said outer shell having an outwardly extending flange for attachment to the transom, a longitudinally extending hollow downwardly open reinforcing strut, and outwardly and downwardly curved edge portions; said inner shell having a curved downwardly concave transverse section and extending to the rear of said upper shell, the forward end of said inner shell being longitudinally rearwardly and upwardly curved from a position adjacent the bottom edge of the transom to overlie the propeller zone to cooperate with the transverse curvature to define a water guide channel effective to produce an upward flow of water in which a propeller is positioned for surface running the transverse vertical section of said inner shell at the propeller zone conforming generally to the propeller arc, the portion of the inner shell rearwardly from the propeller zone being of substantially uniform transverse cross-section and the portion of the inner shell between the propeller zone and its forward end having its bottom surface downwardly concave in both longitudinally and transverse vertical cross-section, said inner and outer shells being formed of reinforced plastic and permanently bonded together in zones of substantial area defined by identically shaped curved lateral edge portions.

2. A shroud as defined in claim 1, in which said inner shell closes the bottom open end of said strut to form a reinforcing box-section.

3. A shroud as defined in claim 2, in which said box-section mounts a substantially vertical rudder post.

4. A shroud for attachment to the rear surface of ransom of an inboard motor boat having a propeller shaft and shaft housing extending rearwardly with clearance through an enlarged opening in the transom, said shroud having a lower surface overlying and partly surrounding a propeller at the propeller zone to be occupied by the propeller and extending aft thereof, the portion of said shroud forwardly of the propeller zone having a smooth continuous uninterrupted bottom surface which is downwardly concave in both longitudinal and transverse vertical cross-sections, the portion of said shroud at the propeller zone having a bottom surface which in vertical transverse planes have a substantially acruate cross-section having a radius of curvature slightly greater than the radius of the arc described by the tips of propeller blades, the portion of the shroud at and rearwardly of the propeller zone having a lower surface of substantially uniform downwardly concave cross-section in vertical transverse planes, the lower surface of said shroud having a cross-section in its vertical central longitudinal plane which extends upwardly and rearwardly from a position adajacent the bottom of the shroud at its forward end in a smooth downwardly concave curve having a maximum curvature at its forward end which diminishes to substantially zero at the propeller zone, the lateral edges of the shroud extending upwardly and rearwardly from the bottom of the shroud at its forward end through points only slightly below the top of the circle defined by the tops of the propeller blades at the propeller zone, said shroud having a central longitudinally extending downwardly open hollow reinforcing rib extending for the full length thereof, a closure for the bottom of said rib forming a box-section therewith and pivot means for a rudder extending substantially vertically through said rib and closure at the rear end thereof.

* * * * *